US012012193B1

(12) United States Patent
Oliverio et al.

(10) Patent No.: US 12,012,193 B1
(45) Date of Patent: Jun. 18, 2024

(54) TROLLING MOTOR MOUNT

(71) Applicants: John D. Oliverio, Brandon, FL (US); Nicholas A. Vicari, Tampa, FL (US); Christopher A. Konow, Odessa, FL (US)

(72) Inventors: John D. Oliverio, Brandon, FL (US); Nicholas A. Vicari, Tampa, FL (US); Christopher A. Konow, Odessa, FL (US)

(73) Assignee: JL Marine Systems, Inc., Tampa, FL (US)

( * ) Notice: Subject to any disclaimer, the term of this patent is extended or adjusted under 35 U.S.C. 154(b) by 48 days.

(21) Appl. No.: 17/803,376

(22) Filed: Jun. 2, 2022

Related U.S. Application Data

(60) Provisional application No. 63/258,890, filed on Jun. 3, 2021.

(51) Int. Cl.
*B63H 20/00* (2006.01)
*B63H 20/02* (2006.01)
*B63H 20/06* (2006.01)

(52) U.S. Cl.
CPC ..... *B63H 20/007* (2013.01); *B63H 20/02* (2013.01); *B63H 20/06* (2013.01)

(58) Field of Classification Search
CPC .... B63H 20/007; B63H 20/106; B63H 20/12; B63H 20/02
USPC ..... 248/642
See application file for complete search history.

(56) References Cited

U.S. PATENT DOCUMENTS

| | | | | | |
|---|---|---|---|---|---|
| 3,486,724 | A * | 12/1969 | Adamski | B63H 20/22 | 248/642 |
| RE28,176 | E * | 10/1974 | Horton | B63H 20/007 | 440/62 |
| 4,410,161 | A * | 10/1983 | Booty | B63H 20/007 | 248/642 |
| 4,966,566 | A * | 10/1990 | Baird | B63H 20/007 | 248/642 |
| 5,277,630 | A * | 1/1994 | Clark | B63H 20/007 | 248/642 |
| 6,447,348 | B1 * | 9/2002 | Gilley | B63H 20/007 | 440/62 |
| 10,906,622 | B1 * | 2/2021 | Boks | B63H 20/007 | |
| 11,447,220 | B2 * | 9/2022 | Bragg | B63B 34/20 | |
| 2007/0232157 | A1 * | 10/2007 | Lee | B63H 20/007 | 440/6 |
| 2023/0145629 | A1 * | 5/2023 | Hagi | B63H 20/10 | 248/642 |

* cited by examiner

*Primary Examiner* — Nkeisha Smith
(74) *Attorney, Agent, or Firm* — Arthur W. Fisher, III, P.A.

(57) ABSTRACT

A trolling motor mount to mount a trolling motor to a boat consisting of a multi-bar change point apparatus to lock the trolling motor in either a stowed position or a deployed position and a release assembly to unlock and move the multi-bar change point apparatus from either the stowed position to the deployed position or from the deployed position to the stowed position.

6 Claims, 12 Drawing Sheets

TROLLING MOTOR MOUNT

CROSS REFERENCE

This utility application claims priority of provisional application Ser. No. 63/258,890, filed Jun. 3, 2021.

BACKGROUND OF THE INVENTION

Field of the Invention

A trolling motor mount comprising a multi-bar change point apparatus to selectively secure a trolling motor in either a stowed position or a deployed position.

Description of the Prior Art

Trolling motors are often used by fishermen to provide a small amount of thrust to slowly and quietly propel a boat while fishing. Typically these trolling motors comprise an elongate shaft or hollow tube having a lower propulsion unit secured to one end thereof and an upper trolling motor head unit at the opposite end. The elongate tube may be mounted to the bow or the transom of the boat by a mounting mechanism. Generally these mounting mechanisms allow the trolling motor to be removed from the water when not in use.

U.S. Pat. No. 7,722,417 relates to a mount for securing a trolling motor to a watercraft comprising a base, a main arm, a motor coupling and a linkage. The motor coupling is configured to rotatably retain the trolling motor. The main arm is pivotally coupled to the base. The linkage is pivotally coupled with the base and the main arm and extends within the main arm to contact the motor coupling for actuating rotation of the motor coupling between a first position when the main arm is in a stowed position and a second position when the main arm is in a deployed position.

U.S. Pat. No. 6,325,685 discloses a trolling motor system comprising a chassis coupled to a boat, a housing pivotally coupled to the chassis, a lower propulsion unit, at least one shaft supported by the housing and coupled to the lower propulsion unit at a first end and a drive system including at least one actuator. The at least one shaft extends along a first axis. The first end is movable relative to the housing along the first axis. The drive system includes at least one actuator, a linear drive, a pivot drive and a coupler. The linear drive moves the first end of the first shaft along the first axis while the pivot drive pivots the housing about a second axis. The coupler connects the actuator and the pivot drive to pivot the housing. In one embodiment, the coupler connects the actuator and the pivot drive based upon the position of the at least one shaft along the first axis.

U.S. Pat. No. 8,814,129 describes a trolling motor mount comprising a base to attach the mount to a watercraft, an arm assembly pivotally attached to the base, a motor mount assembly pivotally attached to the arm assembly for rotatably securing the trolling motor, and an actuator adapted to move the arm assembly between a fully deployed position and a fully stowed position.

U.S. Pat. No. 7,972,188 shows an apparatus for mounting a trolling motor to a watercraft comprising a bracket, a coupling hinge, a lift arm, a cam mechanism, a collet, a resistance knob, a first bias spring and a second bias spring. The bracket is configured to mount on a transom or a gunnel of the watercraft. The coupling hinge receives a shaft of the trolling motor therethrough to retain the trolling motor via the collet and resistance knob mounted thereon. The collet and knob can be selectively tightened or loosened about the shaft of the trolling motor. The bracket defines detents and an arcuate track in which a track follower portion of the coupling hinge can move. The movement of the coupling hinge along the bracket tilts the trolling motor between a stowed position and a deployed position. The lift arm is pivotally coupled to the coupling hinge and carries a locking pin. The lift arm is biased by the first bias spring such that the locking pin engages the detents. The cam mechanism is pivotally coupled to the bracket and is biased by the second bias spring to disengage the locking pin from a lower portion of the detents.

Additional examples of the prior art are found in U.S. Pat. Nos. 6,369,542 and 9,296,455.

While some of the prior art may contain some similarities relating to the present invention, none of them teach, suggested or include all of the advantages and unique features of the invention disclosed hereafter.

SUMMARY OF THE INVENTION

The present invention relates to a multi-bar change point apparatus to selectively position a trolling motor in either a stowed position when not in use or deployed position when in use.

The multi-bar change point apparatus includes a side frame member extending upwardly from each side of a base and held in substantially parallel relationship by a rotatable transverse rod or shaft and a distal transverse rod or shaft.

An interconnecting link or arm disposed on each side of the multi-bar change point apparatus is rotatably or pivotally coupled between a pair of corresponding actuator links or arms and a trolling motor support or cradle including a pair of cradle arms.

A stabilizer plate including a stabilizer notch is affixed or attached to each interconnecting link or arm to receive and engage a corresponding stabilizer projection or protrusion extending upwardly from the proximal to mid-portion of each side frame member to stabilize the multi-bar change point apparatus when in the deployed configuration or position.

The multi-bar change point apparatus also includes a stowed retainer assembly to secure the multi-bar change point apparatus in the stowed configuration or position. Specifically, the stowed retainer assembly comprises a resilient roller or ring rotatably mounted on opposite end portions of a transverse rod or shaft extending between the corresponding interconnecting links or arms and a corresponding retainer clamp or member mounted or connected to the trolling motor or control housing such that when the multi-bar change point apparatus is in the stowed configuration or position each retainer clamp or member engages the upper surface of the corresponding resilient roller or ring to exert a downward force securing the multi-bar change point apparatus in the stowed or locked configuration or position.

The multi-bar change point apparatus also includes a deployed configuration or retainer assembly to secure the multi-bar change point apparatus in the deployed configuration or position. In particular, the deployed retainer assembly comprises a bias coupled between a post or mounting pin extending inwardly from the corresponding interconnecting link or arm, or the stabilizer plate and a post or mounting pin extending inwardly from the corresponding side frame member or the corresponding side of base to bias or pull each interconnecting link or arm downward to secure the multi-bar change point apparatus 10 in the deployed configuration or position.

The geometry of the multi- or 4-bar change point linkage consists of a first bar extending along each side frame member or along the base to the corresponding rotational point of each actuator link or arm attached to the rotatable proximal hexagonal transverse rod or shaft, a second bar extending from rotational point of each actuator link or arm on the rotatable proximal hexagonal transverse rod or shaft to the corresponding pivot pin or member at the proximal end portion of the corresponding interconnecting link or arm, a third bar extending from each pivot pin or member at the proximal end portion of the corresponding interconnecting link or arm to the corresponding pivot pin or member at the opposite or distal end portion thereof connected to corresponding end portion of the distal transverse rod and a fourth bar extending from each pivot pin or member to the corresponding origin of the first bar extending along the corresponding side frame member or along the base.

The trolling motor mount further includes a release mechanism rotatably mounted on the rotatable transverse rod or shaft to unlock or release the multi-bar change point apparatus from either the stowed configuration or position or the deployed configuration or position.

During the deploying sequence the trolling motor is rotated from the stowed position to the deployed position as a release assembly rotates a stowed release member lifting the resilient rollers or rings upward rotating the interconnecting links or arms and corresponding actuator links or arms upward releasing or unlocking the multi-bar change point apparatus from the stowed configuration or position.

During the stowing sequence the trolling motor is rotated from the deployed position to the stowed position as the release mechanism rotates the rotatable transverse rod or shaft rotating each actuator link or arm and corresponding interconnecting link or arm to initiate the stowing sequence.

Toward the end of the stowing sequence the retainer clamps or members are rotated to engage the resilient rollers or rings to secure the trolling motor in the stowed position.

This Summary is not intended to describe essential features of the claimed subject matter nor is it intended to limit the scope of the claimed subject matter. To the contrary, this Summary merely outlines various concepts and features that are developed in the Detailed Description.

BRIEF DESCRIPTION OF THE DRAWINGS

For a fuller understanding of the nature and object of the invention, reference should be had to the following detailed description taken in connection with the accompanying drawings in which.

Similar reference characters refer to similar parts throughout the several views of the drawings.

DETAILED DESCRIPTION OF THE INVENTION

Figure 4:
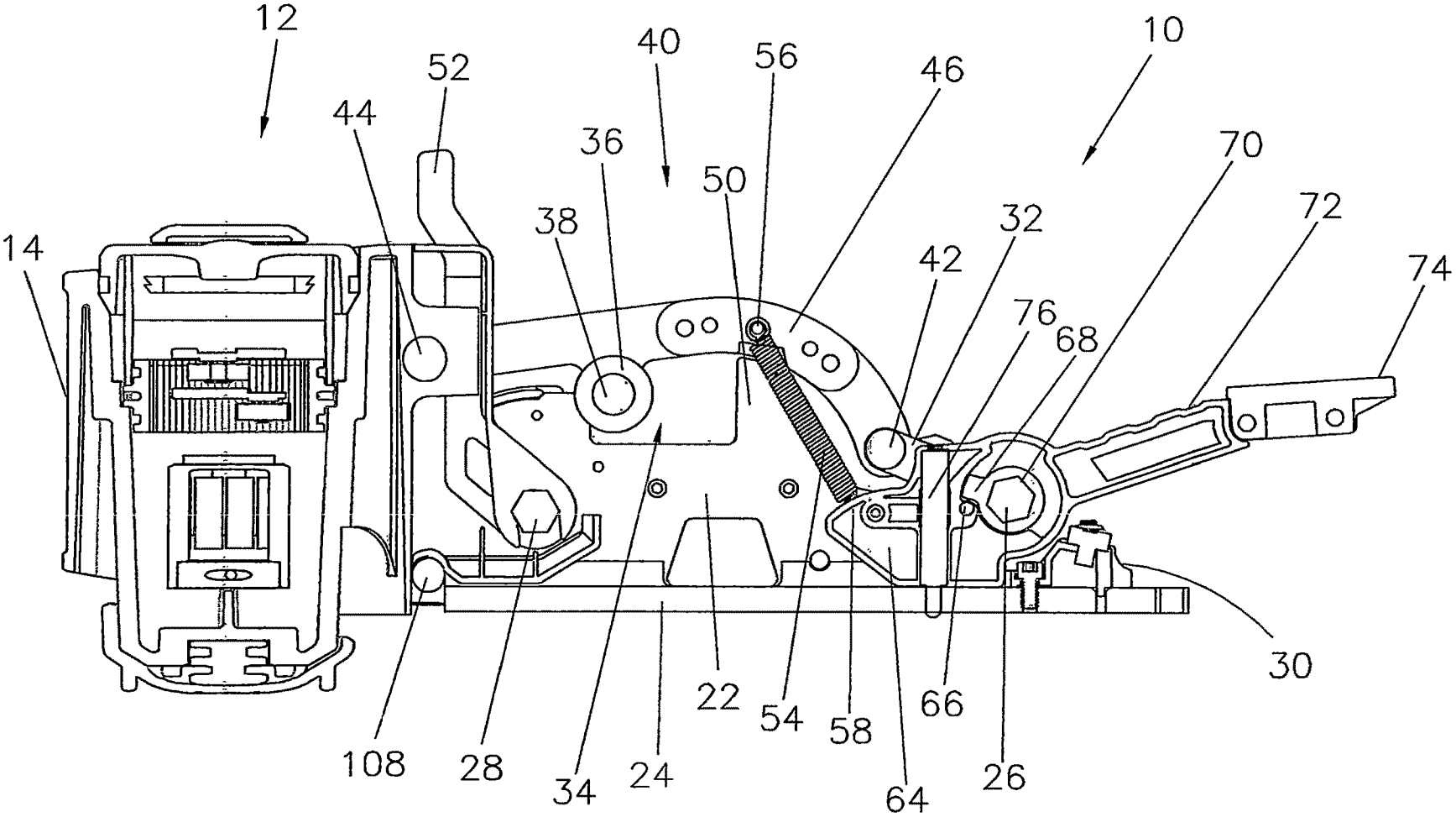
FIG. 4 is a partial cut-away side view of the trolling motor mount of the present invention in the deployed position.
Figure 7:
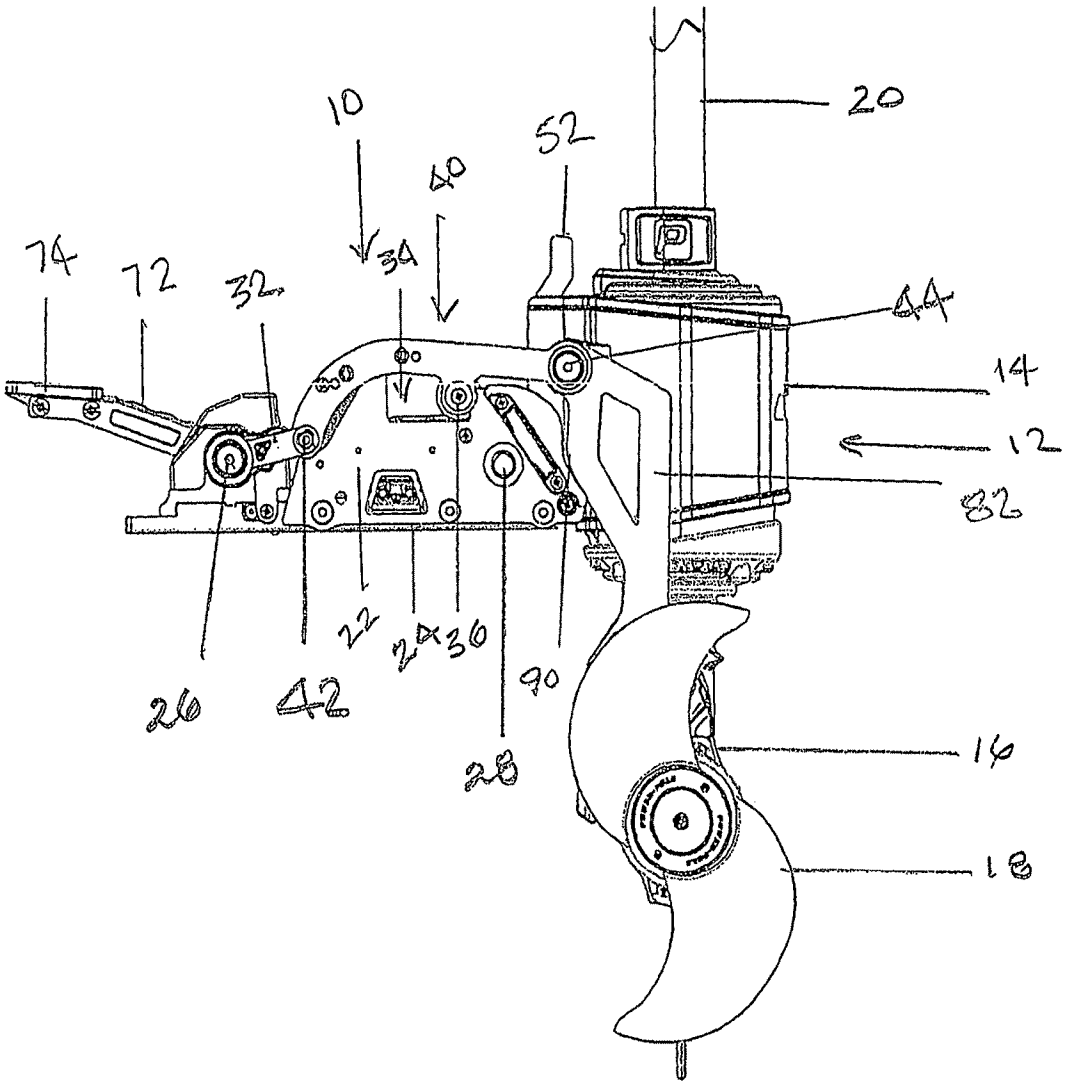
FIG. 7 is a side view of the trolling motor mount of the present invention in the deployed position.

The present invention relates to a multi-bar change point apparatus generally indicated as 10 to selectively position a trolling motor generally indicated as 12 including a control housing 14, propulsion unit 16, propeller 18 and shaft in a stowed position when not in use (FIGS. 1 and 5) or a deployed position when in use (FIGS. 4 and 7).

The multi-bar change point apparatus 10 includes a side frame member 22 extending upwardly from each side of a base 24 and held in substantially parallel relationship by a proximal rotatable substantially hexagonal transverse rod or shaft 26 and a distal transverse mounting rod 28. Concave surfaces 30 are formed on the proximal portion of the base 24 to support corresponding outer actuator link or arm 32 when the trolling motor 12 is in the stowed position. A notch or space 34 is formed in the mid-upper portion of each side frame member 22 to receive a corresponding substantially circular resilient roller or ring 36 mounted on opposite end portions of a transverse shaft 38.

The trolling motor 12 and control housing 14 are rotatably coupled or mounted between the side frame members 22 by the distal transverse mounting rod 28.

An interconnecting member including a proximal substantial arcuate portion and a distal substantially straight portion forming a substantially J-shaped link or arm generally indicated as 40 disposed on each side of the multi-bar change point apparatus 10 is rotatably or pivotally coupled between a corresponding actuator link or arm 32 at the proximal end portion thereof by a pivot pin or member 42 and a distal transverse rod 44 coupled to the trolling motor 14.

Figure 2:
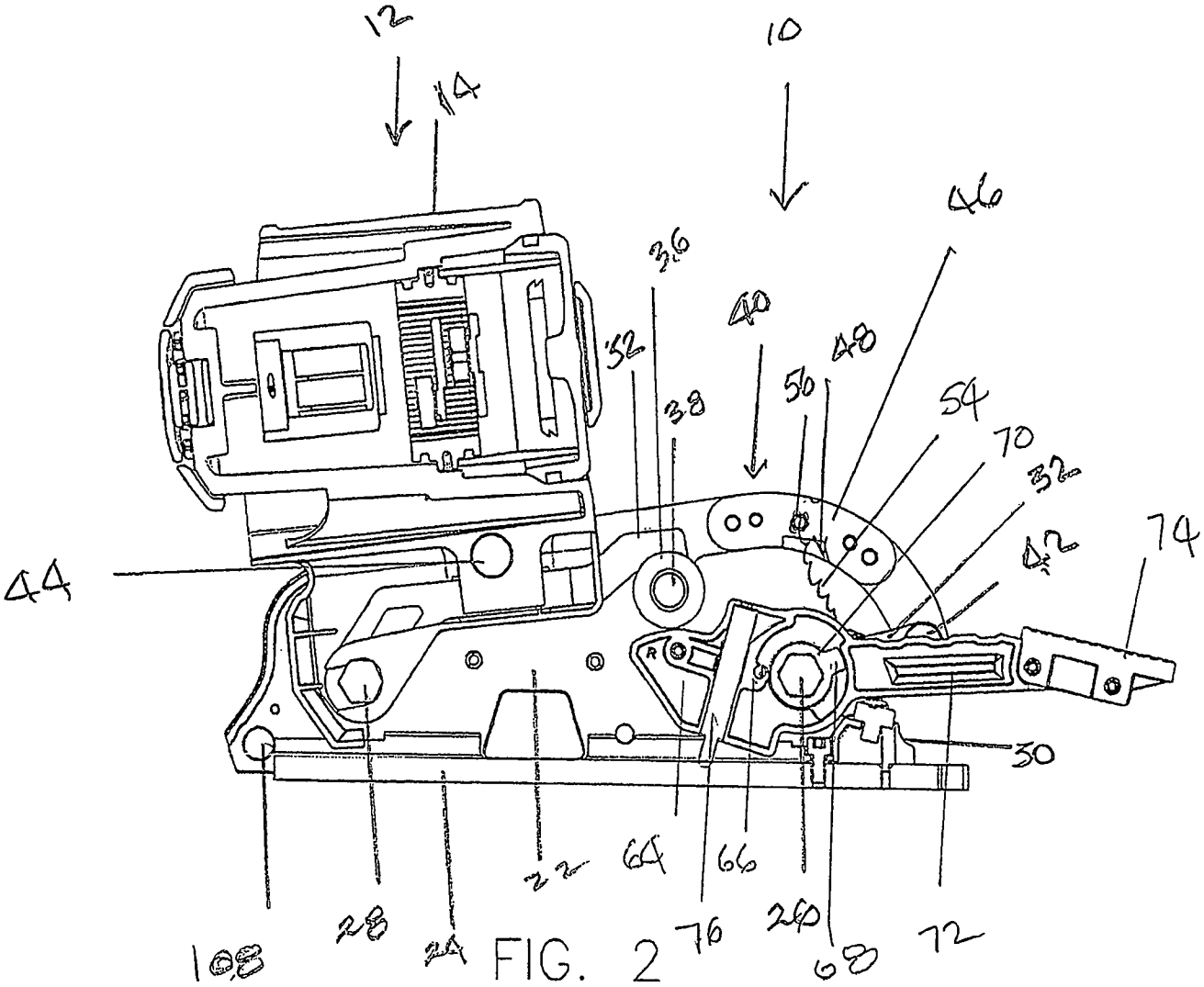
FIGS. 2 and 3 are partial cut-away views of the trolling motor mount of the present invention transitioning either from the stowed position to the deployed position or from the deployed position to the stowed position.
Figure 3:
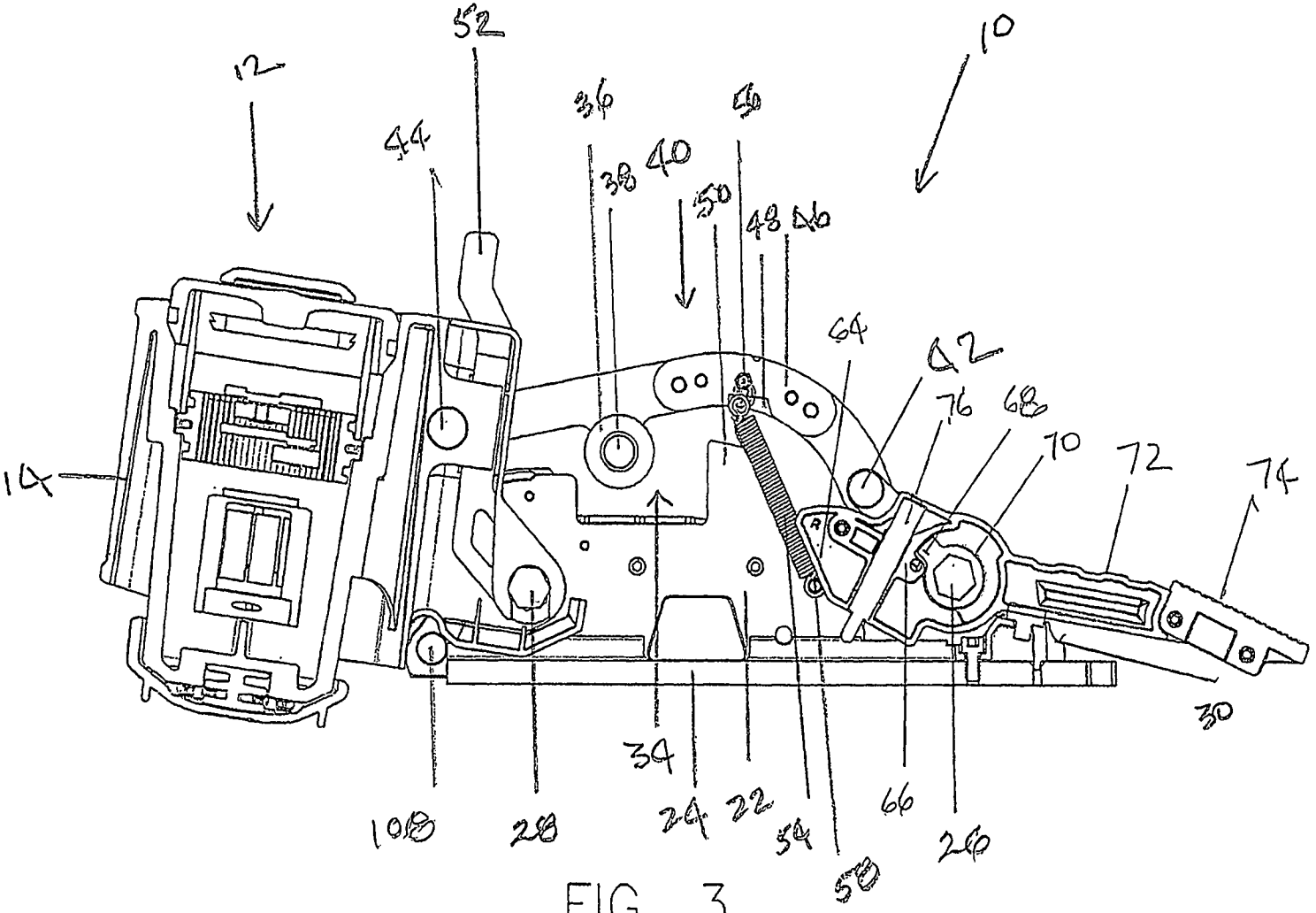

As best shown in FIGS. 2 and 3, a stabilizer plate 46 including a stabilizer notch 48 is affixed or attached to the inside of each substantially J-shaped interconnecting link or arm 40 to receive and engage a corresponding stabilizer projection or protrusion 50 extending upwardly from the proximal to mid-portion of each side frame member 22 to stabilize the multi-bar change point apparatus 10 by restricting movement of the substantially J-shaped interconnecting links or arms when in the deployed position. Of course, the stabilizer notch 48 may be formed on one or both substantially J-shaped interconnecting links or arms 40.

As shown in FIGS. 1-4, the multi-bar change point apparatus 10 also includes a stowed retainer assembly to secure the multi-bar change point apparatus 10 in the stowed position. Specifically, the stowed retainer assembly comprises the substantially circular resilient roller or ring 36 rotatably mounted on opposite end portions of the transverse rod or shaft 38 extending laterally between the mid-portions of the corresponding substantially J-shaped interconnecting links or arms 40 and corresponding retainer clamps or members 52 attached or mounted on or to the trolling motor 12 or the control housing 14 such that when the multi-bar change point apparatus 10 is in the stowed position each retainer clamp or member 52 engages the upper surface of the corresponding substantially circular resilient roller or ring 36 to exert a downward force securing the multi-bar change point apparatus 10 in the stowed or locked configuration or position.

As best shown in FIGS. 3 and 4, the multi-bar change point apparatus 10 also includes a retainer assembly to secure the multi-bar change point apparatus in the deployed configuration or position. In particular, the deployed retainer assembly comprises a bias or spring 54 coupled between a post or mounting pin 56 extending inwardly from the corresponding substantially J-shaped interconnecting link or arm 40 or the proximal substantially arcuate of the stabilizer plate 46 and a post or mounting pin 58 extending inwardly from the corresponding side frame member 22 or the corresponding side of the base 24 to exert a downward force pulling each substantially J-shaped interconnecting link or arm 40 downward to secure the multi-bar change point apparatus 10 in the deployed or locked configuration or position.

As best shown in FIGS. 1, 4, 8 and 9 geometry of the multi- or 4-bar change point linkage consists of a first bar shown as VL 01 extending along each side frame member 22 or along each side of the base 24 from opposite end portions the distal transverse mounting rod 28, point A to the corresponding rotational point of each actuator link or arm 32 attached or affixed to the rotatable proximal hexagonal transverse rod or shaft 26 point B a second bar shown as VL 02 extending from rotational point of each actuator link or arm 32 on the rotatable proximal hexagonal transverse rod or shaft 26, point B, to the corresponding pivot pin or member 42, point C, at the proximal end portion of the corresponding J-shaped interconnecting link or arm 40, a third bar shown as VL 03 extending from each pivot pin or member 42, point C at the proximal end portion of the corresponding substantially J-shaped interconnecting link or arm 40 to the corresponding end portion of the distal transverse shaft or rod 44, point D, and a fourth bar shown a VL 04 extending from opposite end portions of the distal transverse rod or shaft to the corresponding distal transverse mounting rod 28, point A, of the first bar extending along the corresponding side frame member 22 or along the base 24.

Figure 8:
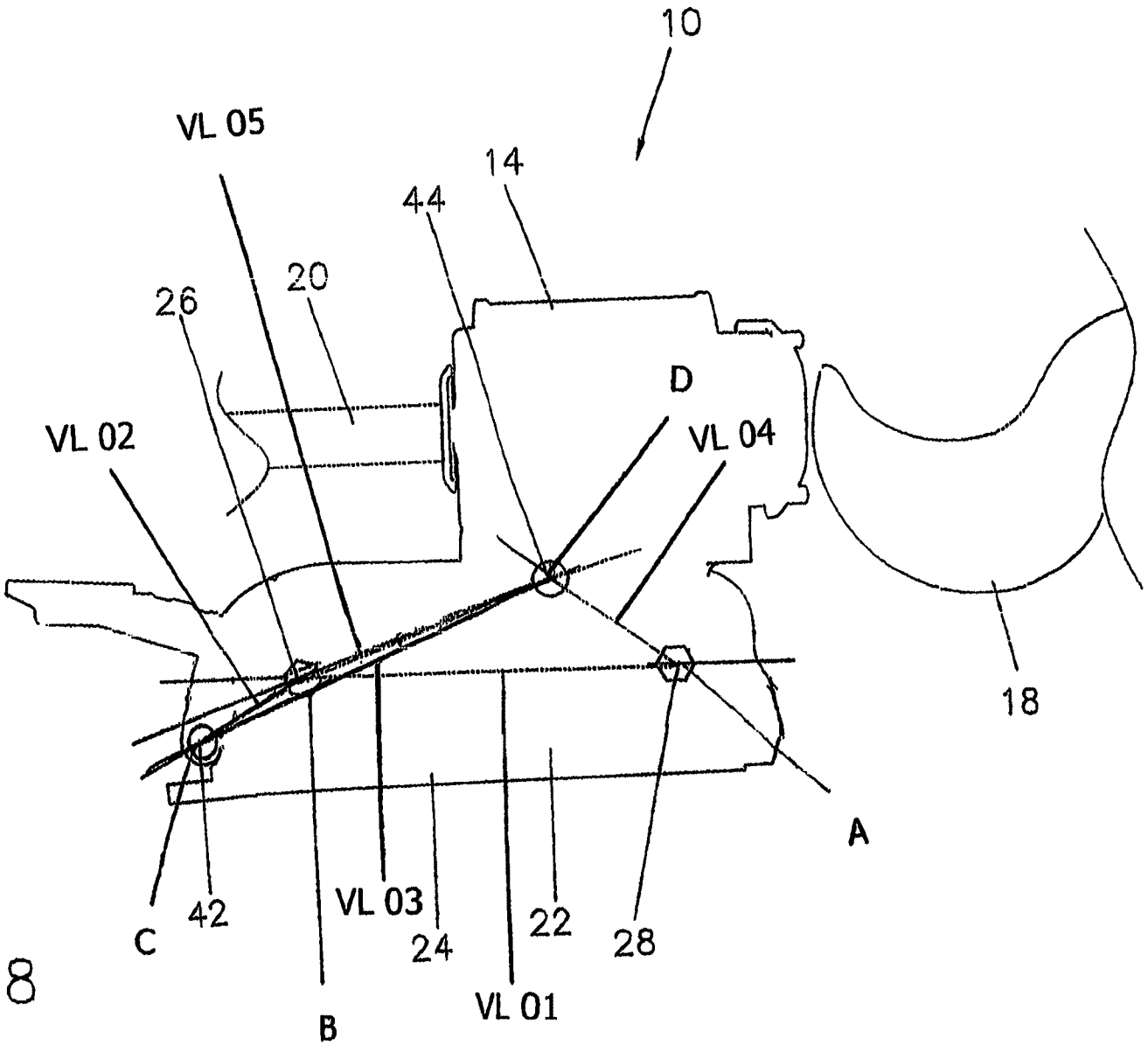
FIG. 8 is a graphic side view of the multi-bar change points of the trolling motor mount of the present invention in the stowed position.

As shown in FIG. 8, when the trolling motor 12 is in the stowed position, the pivot pins or members 42 coupling the corresponding substantially J-shaped interconnecting link or arm 40 to the corresponding actuator link or arm 32 are disposed below a virtual line VL 05 drawn from the points of rotation of the rotatable proximal substantially hexagonal transverse rod or shaft 26 at the proximal end portions of the corresponding substantially J-shaped links or arms 40 to the corresponding end portions of the transverse rod or shaft 44 locking the multi-bar change point apparatus 10 in the stowed configuration or position.

Figure 9:
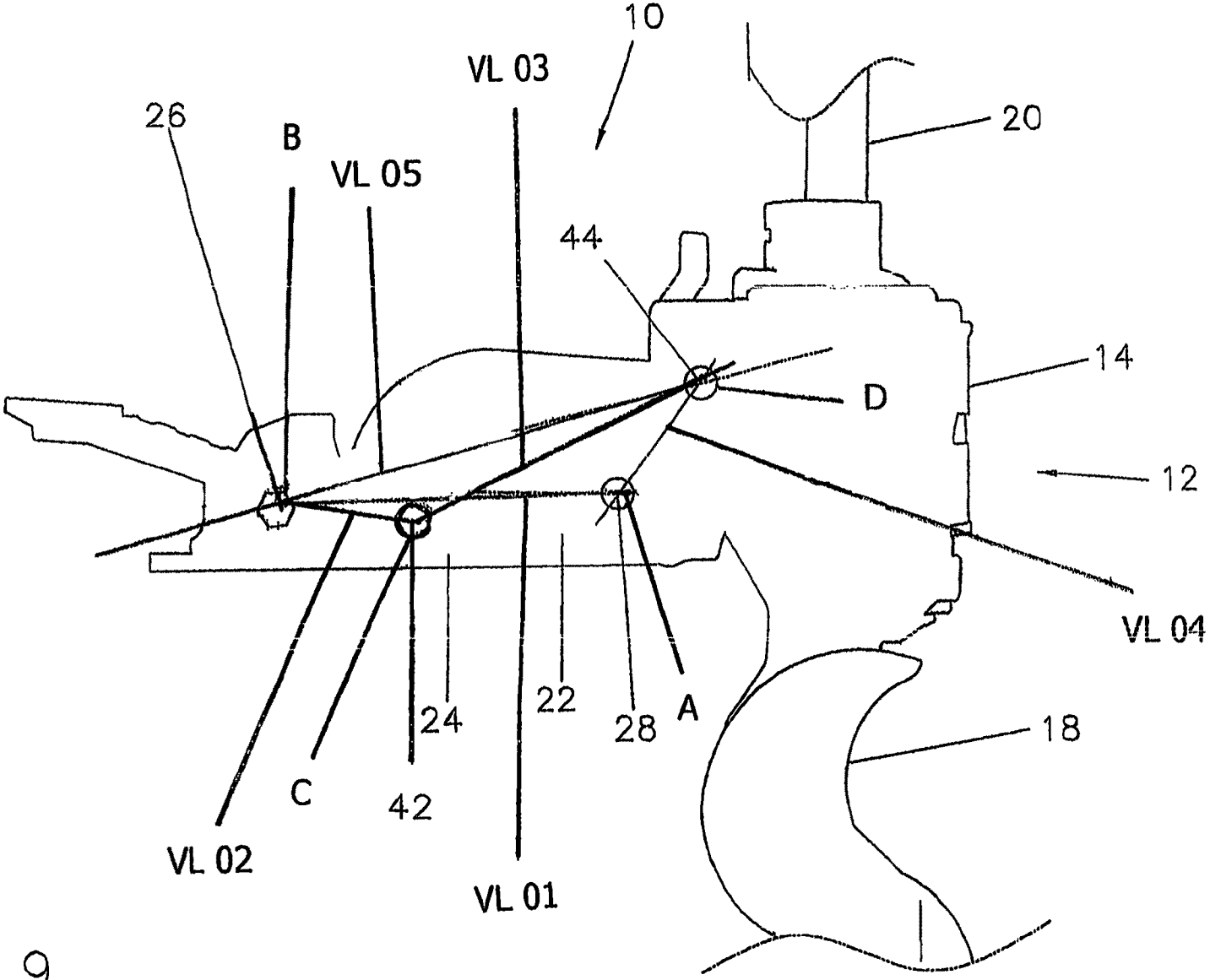
FIG. 9 is a graphic side view of the multi-bar change points of the trolling motor mount of the present invention in the deployed position.

As shown in FIG. 9, when the trolling motor 12 is in the deployed position, the pivot pins or members 42 coupling the corresponding substantially J-shaped interconnecting link or arm 40 to corresponding actuator link or arm 34 are disposed below a the virtual line VL 05 drawn from the points of rotation of the rotatable proximal substantially hexagonal transverse rod or shaft 26 at the proximal end portions of the corresponding substantially J-shaped interconnecting links or arms 32 to the corresponding end portion of the transverse rod or shaft 44 locking the multi-bar change point apparatus 10 in the deployed configuration or position.

Figure 10:
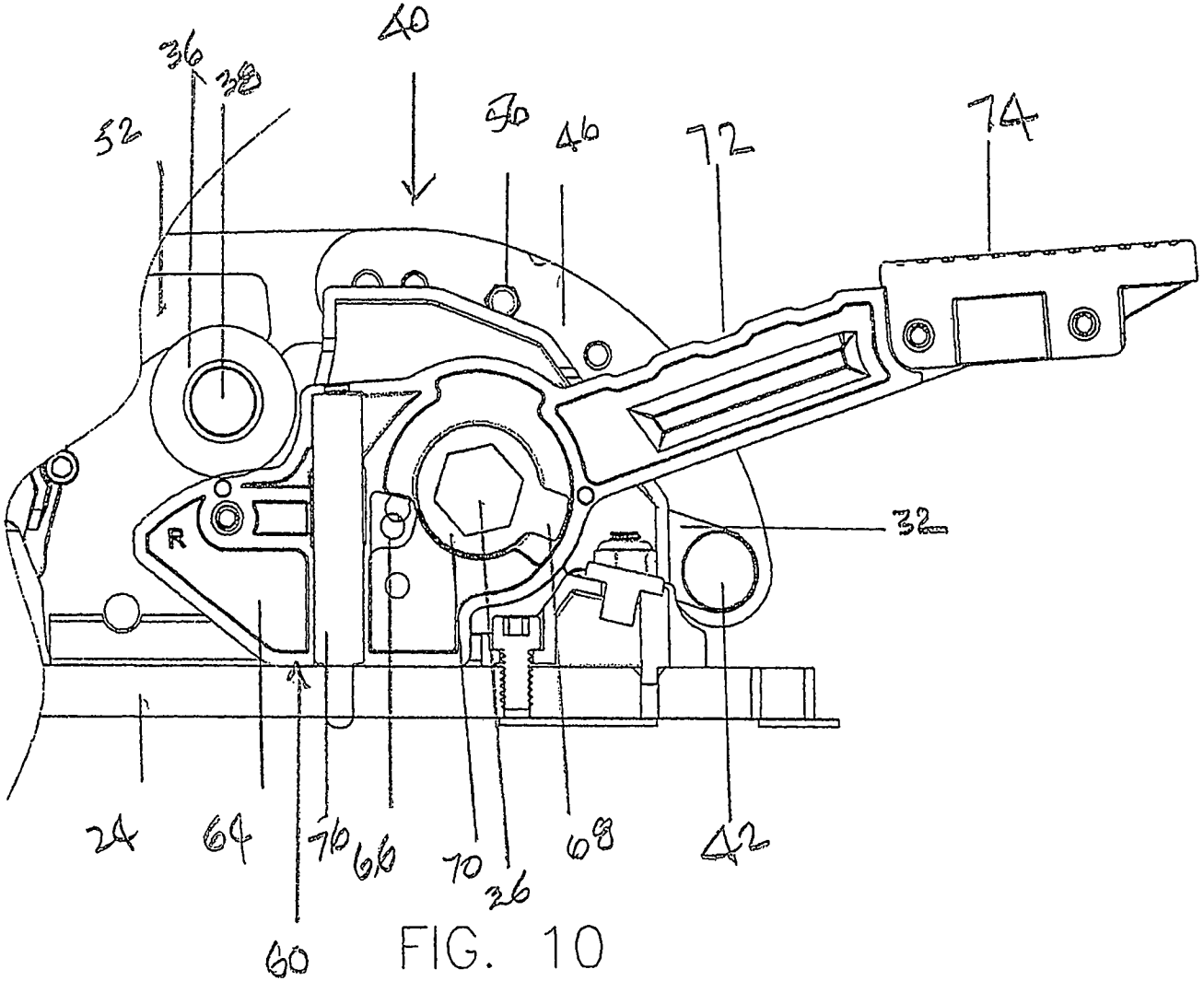
FIG. 10 is a side view of the release mechanism of the trolling motor mount of the present invention in the stowed position.
Figure 11:
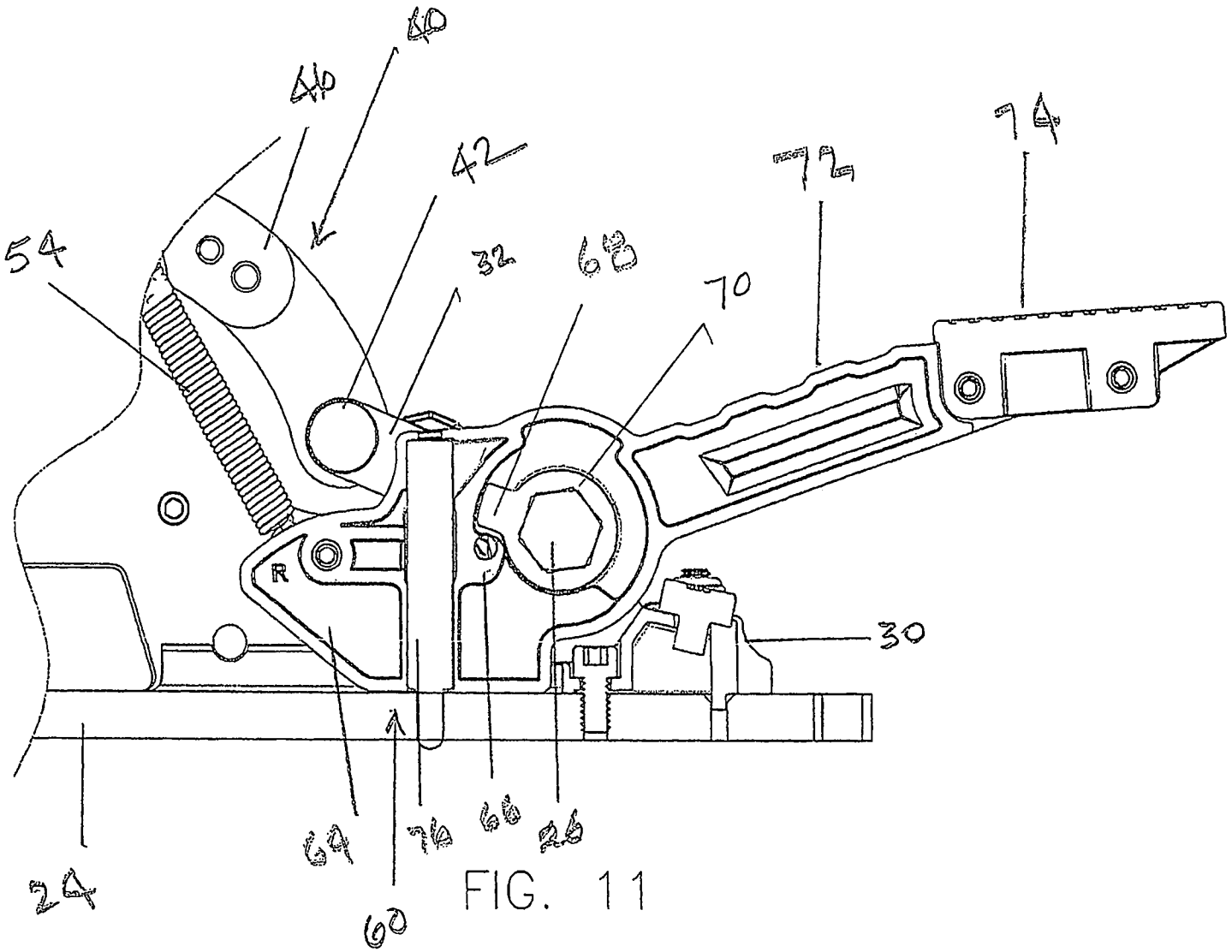
FIG. 11 is a side view of the release mechanism of the trolling motor mount of the present invention in the deployed position.
Figure 12:
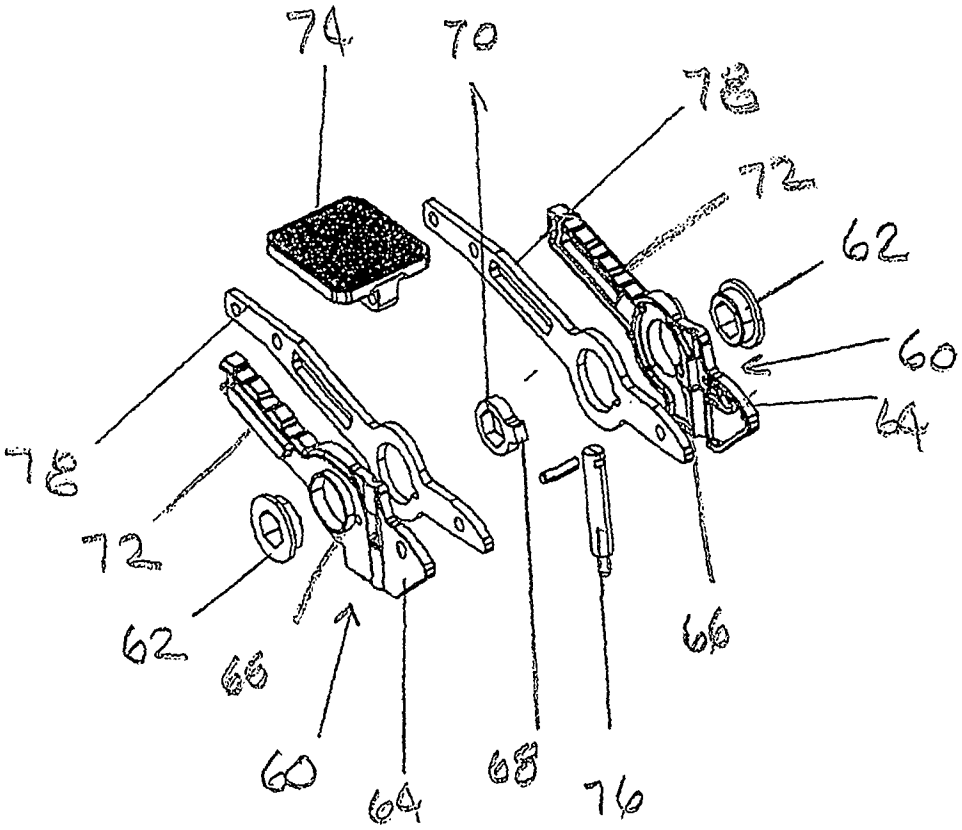
FIG. 12 is an exploded perspective view of the release mechanism of the trolling motor mount of the present invention.

As shown in FIGS. 10 through 12, the trolling motor mount further includes a release mechanism coupled to the rotatable proximal substantially hexagonal transverse rod or shaft 26 to unlock or release the multi-bar change point apparatus 10 from the stowed configuration or position and move the trolling motor 12 to the deployed position or to unlock or release the multi-bar change point apparatus 10 from the deployed configuration or position and to move the trolling motor 12 to the stowed position.

Specifically, the release mechanism comprises an actuator assembly including a pair of actuator members each generally indicated as 60 rotatably coupled to the rotatable substantially hexagonal transverse rod or member 26 by a pair of mounting nuts each indicated as 62.

A stowed release member 64 is formed on the distal portion of each actuator member 60 to selectively engage the corresponding substantially circular resilient roller or ring 36; while, a deployed release member 66 is formed on the proximal portion or each actuator member 60 to selectively engage a corresponding tab 68 extending outwardly from a mounting ring 70 secured to the rotatable proximal substantially hexagonal transverse rod or member 26. As shown in FIG. 12, the release mechanism further includes a positioning assembly comprising a pair of pedal arms each indicated as 72 coupled to the rotatably proximal substantially hexagonal transverse shaft or rod 26 and a foot pedal 74 to rotate the rotatable proximal substantially hexagonal transverse shaft or rod 26. The release mechanism also including damping devices 76 to control the motion of the pedal arms 72 and foot pedal 74. Stiffeners 78 may be used to reinforce the pedal arms 72.

Figure 5:
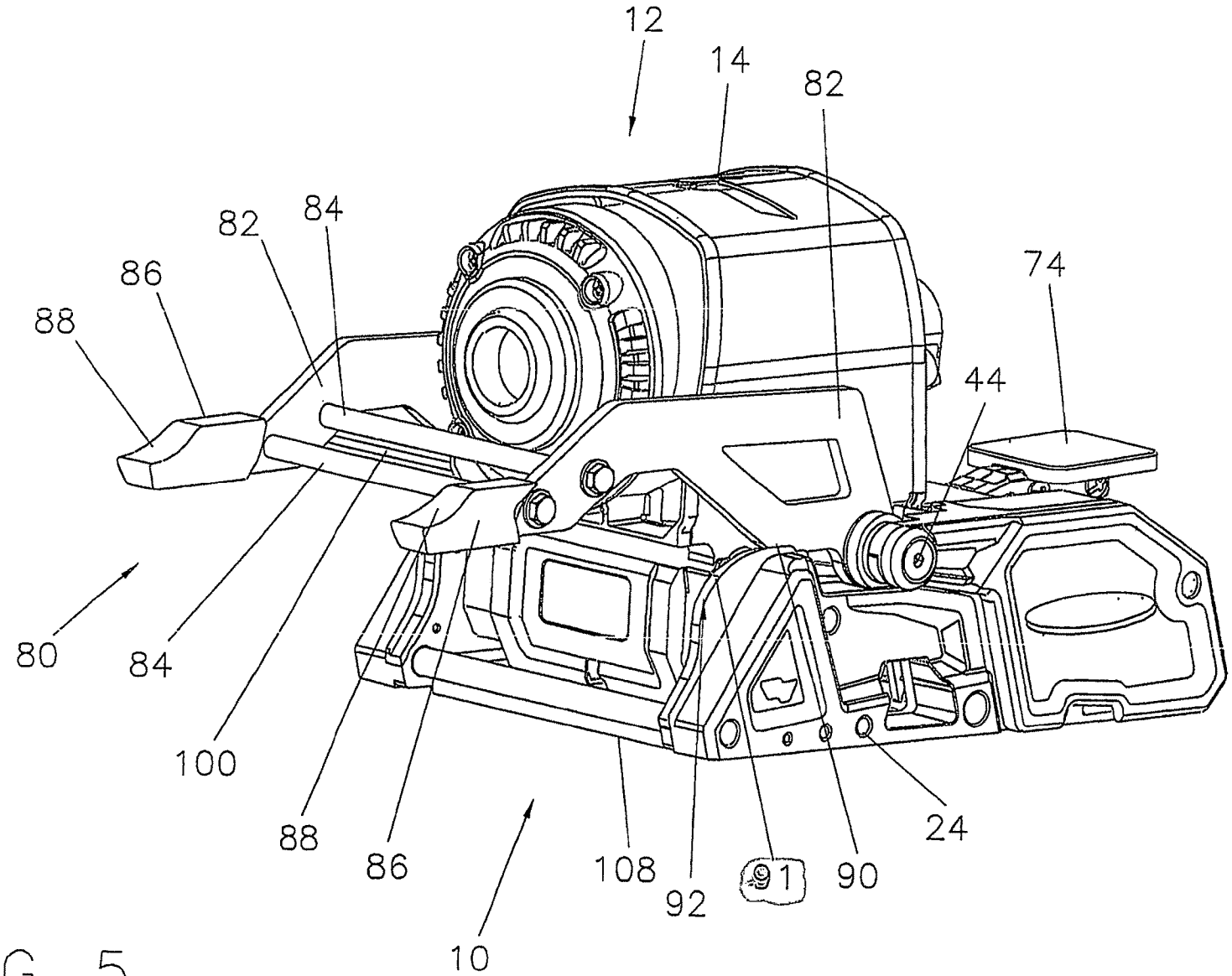
FIG. 5 is a perspective view of the trolling motor mount and trolling motor support or cradle of the present invention in the stowed position.

As shown in FIG. 5, a trolling motor support or cradle generally indicated as 80 comprising a pair of cradle arms each indicated as 82 is rotatably coupled to the transverse rod 44 and held or secured in spaced relationship to each other by a pair of transverse rods each indicated as 84. A propulsion support 86 including a concave surface 88 is formed at the distal end of each cradle arm 82. Each cradle arm 82 includes a convex cam surface 90 to engage a corresponding convex cam surface 91 having a convex groove or guide 92 formed on the distal end portion of the corresponding side frame member 22 to receive the corresponding convex cam surface 90 therein to control the rotation of the trolling motor 12 when transitioning between the stowed position and the deployed position and during deployment and stowing of the trolling motor 12.

Figure 6:
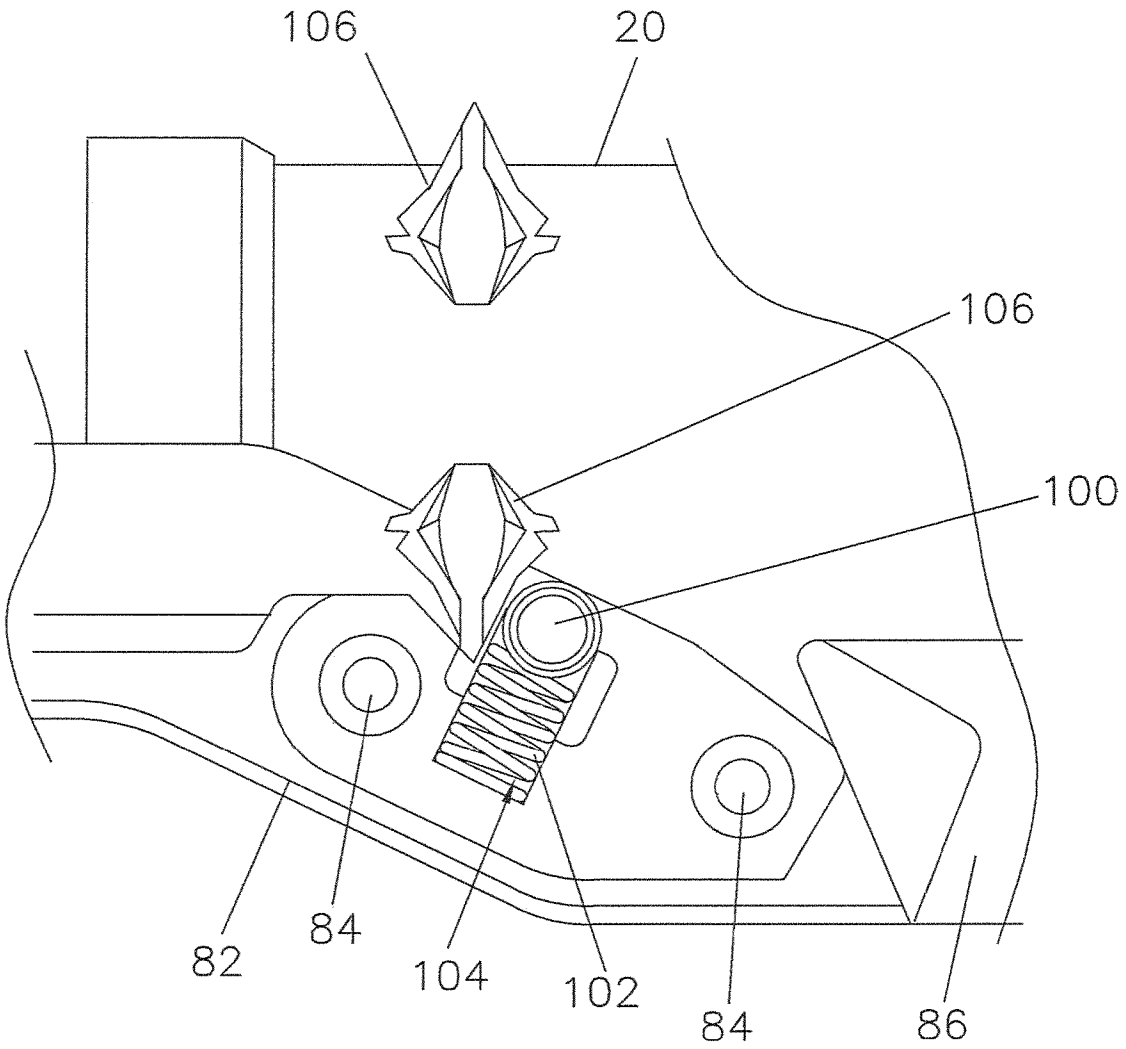
FIG. 6 is a partial side view of the trolling motor lock of the trolling motor mount and trolling motor support or cradle of the present invention with the trolling motor in the stowed and locked position.

As shown in FIG. 6, the trolling motor support or cradle 80 further includes a trolling motor limit mechanism to restrict movement of the trolling motor 12 relative to the multi-bar change point apparatus 10 when trolling motor 12 is in the stowed position. The trolling motor limit mechanism comprises a transverse locking bar 100 extending laterally between the cradle arms 82 movable between a locked position and an unlocked second position normally biased in the locked position by a bias or spring 102 disposed within a corresponding slot or cavity 104 formed in each cradle arm 82.

In use, as the trolling motor 12 is drawn onto the boat a stop 106 formed on the shaft 20 engages the transverse locking bar 100 forcing the transverse locking bar 100 downward against the force of the bias or springs 102 moving the transverse locking bar 100 from the first or locked position to the second or unlocked position allowing the trolling motor 12 to be drawn onto the trolling motor support cradle 80 until the stop 106 is disposed inboard of the transverse locking bar 100. The transverse locking bar 100 is then forced upward by the bias or springs 102 returning the transverse locking bar 100 to the first or locked position to restrict the trolling motor 12 from moving outward off the trolling motor support cradle 80 when the multi-bar change point apparatus 10 is in the stowed configuration or position.

In addition, as the trolling motor 12 is deployed the convex cam surfaces 90 formed on the cradle arms 82 move along the concave cam surfaces 92 formed on the corresponding side frame members 22. Initially, the limit stop 106 engages the transverse bar 100 to prevent the trolling motor 12 from sliding downward into the water. As the trolling motor 12 and the trolling motor support or cradle 38 continue to rotate the corresponding convex grooves or guides 92 forces or separates the stop 106 away from the transverse locking bar 100 allowing the trolling motor 12 to slide into the water.

FIGS. 2 and 3 depict the deploying sequence rotating the trolling motor 12 from the stowed position (FIG. 1) to the deployed position (FIG. 4).

Depressing the proximal foot pedal 74 rotates the stowed release members 60 of the release mechanism upward lifting the corresponding substantially circular resilient rollers or rings 36 upward rotating the substantially J-shaped interconnecting links or arms 32 and corresponding actuator link or arm 34 upward releasing or unlocking the multi-bar change point apparatus 10.

As the trolling motor 12 continues to rotate toward the deployed position, the substantially J-shaped interconnecting links or arms 40 rotate to corresponding outer actuator link or arm 32 rotating the tab 68. As the foot pedal 74 is fully depressed momentum continues to rotate the trolling motor 12 to the deployed position. A lower transverse rod 106 extending between the distal portion of the side frame member 22 limits rotation of the trolling motor 10 past vertical.

As the deploying sequence is completed, the dampeners 76 extending between the base 24 and the positioning assembly engage return the foot pedal assembly 74 to the first position.

When the trolling motor 12 is fully deployed, each protrusion or projection 50 extending upwardly from the corresponding side frame member 20 engages the corresponding notch 48 formed in the corresponding stabilizer plate 46 mounted to the corresponding substantially J-shaped interconnecting arm 30 to further restrict movement of the multi-bar change point apparatus 10.

Figure 1:
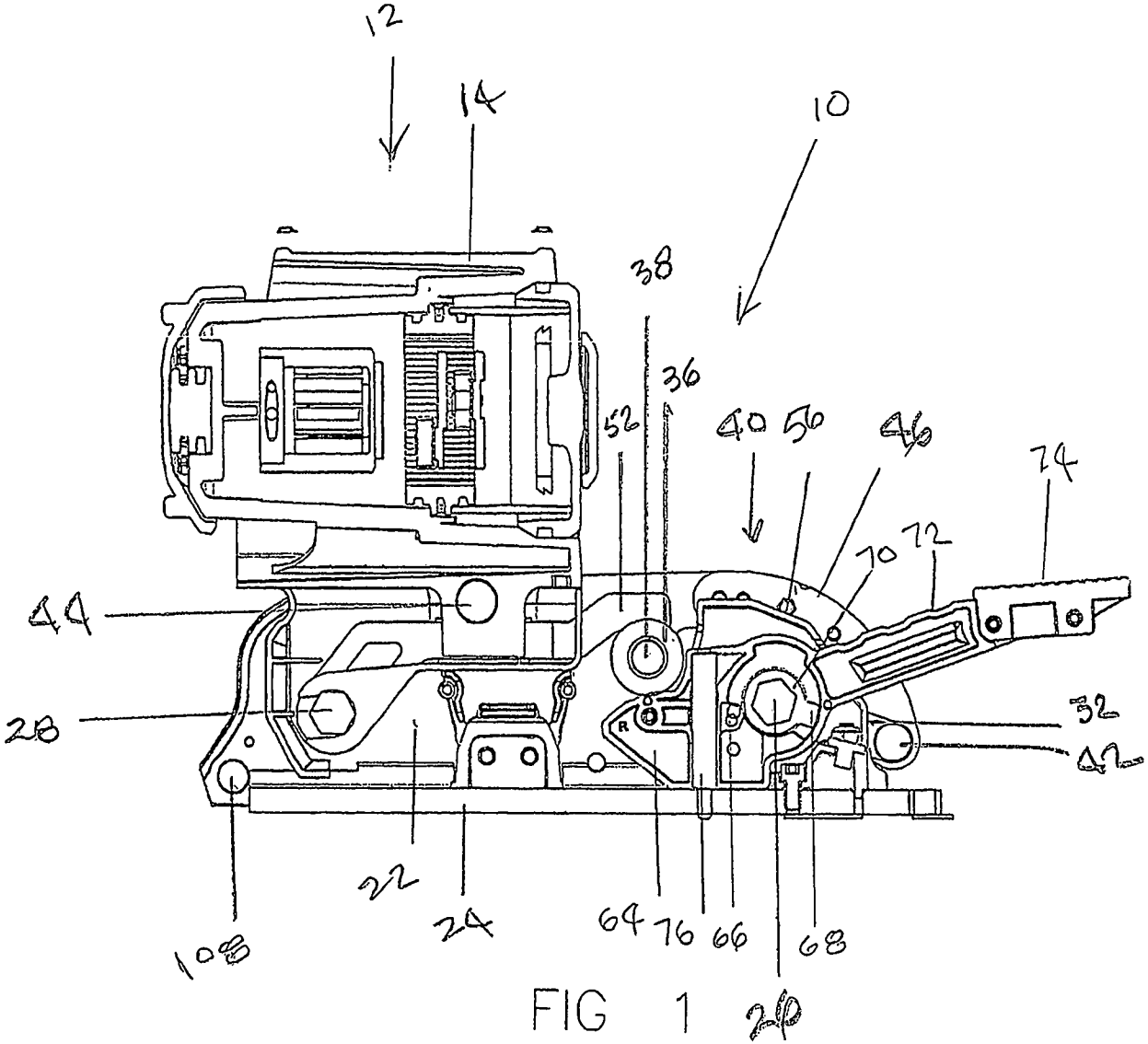
FIG. 1 is a partial cut-away side view of the trolling motor mount of the present invention in the stowed position.

FIGS. 2 and 3 also depict the stowing sequence rotating the trolling motor 12 from the deployed position (FIG. 4) to the stowed position (FIG. 1).

Pressing downward on the foot pedal 74 rotates the release mechanism causing each deployed release member 66 to lift the corresponding tab 68 rotating the rotatable proximal substantially hexagonal transverse rod or shaft 26 rotating the actuator link or arm 34 and the substantially J-shaped interconnecting arm 40 to the stowed position.

As the trolling motor 12 transitions toward the stowed position the tabs 68 disengage the corresponding deployed release members 66.

During the stowing sequence the substantially circular resilient rollers or rings 36 are engaged by the corresponding retainers or members 52 to secure the trolling motor 12 in the stowed position.

Thus it will thus be seen that the objects set forth above, among those made apparent from the preceding description are efficiently attained and since certain changes may be made in the above construction without departing from the scope of the invention, it is intended that all matter contained in the above description or shown in the accompanying drawing shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

In describing the invention, certain terms are used for brevity, clarity, and understanding. No unnecessary limitations should be inferred beyond the requirement of the prior art because such terms are used for descriptive purposes and are intended to be broadly construed. The different structural and functional elements, apparatuses, devices, compositions, and methods described herein may be used alone or in combination with other structural and functional elements, apparatuses, devices, compositions, systems and methods. It is to be expected that various equivalents, alternatives and modifications are possible within the scope of the described elements and structure.

What is claimed is:

1. A trolling motor mount to mount a trolling motor to a boat comprising a multi-bar change point apparatus to lock the trolling motor in either a stowed position or a deployed position and a release mechanism to unlock and move said multi-bar change point apparatus from a stowed configuration to a deployed configuration to move the trolling motor from the stowed position to the deployed position or to unlocked and move said multi-bar change point apparatus from the deployed configuration to the stowed configuration to move the trolling motor from the deployed position to the stowed position, said multi-bar change point apparatus comprises a side frame member extending upwardly from each side of a base and held in substantially parallel relationship by a proximal rotatable transverse shaft and a distal transverse mounting rod and a multi-bar change point linkage of a first bar extending from a corresponding point of said distal transverse mounting rod along each said side frame member to a corresponding rotational point of a corresponding actuator link attached to said proximal rotatable transverse shaft, a second bar extending from a rotational point of each said actuator link on said proximal rotatable transverse shaft to a corresponding pivot member of a corresponding proximal end portion of a corresponding interconnecting link, a third bar extending from each said pivot pin at said proximal end portion of a corresponding interconnecting link connected to a corresponding end portion of a distal transverse shaft and a fourth bar extending from each said end portion of said distal transverse shaft to a corresponding end portion of said distal transverse mounting rod.

2. The trolling motor mount of claim 1 wherein each said interconnecting link includes an arcuate proximal end portion.

3. The trolling motor mount of claim 1 wherein each said interconnecting link comprises a substantially J-shaped configuration.

4. The trolling motor mount of claim 1 when the trolling motor is in the stowed position, a pivot member coupling each interconnecting link arm to a corresponding actuator link disposed below a virtual line drawn from points of rotation of said proximal rotatable transverse shaft at proximal end portions of corresponding interconnecting link to said pivot members coupling distal end portions of corresponding interconnecting link and said distal transverse shaft locking said multi-bar change point apparatus in the stowed position.

5. The trolling motor mount of claim 4 when the trolling motor is in the deployed position, said pivot members coupling each interconnecting link to a corresponding actuator link are disposed below a virtual line drawn from points of rotation of said proximal rotatable transverse shaft at proximal end portions of corresponding interconnecting link to said pivot members coupling the distal end portions of the corresponding interconnecting link and said distal transverse shaft locking said multi-bar change point apparatus in the deployed position.

6. The trolling motor mount of claim 1 when the trolling motor is in the deployed position, said pivot members coupling each interconnecting link to a corresponding actuator link are disposed below a virtual line drawn from points of rotation of said proximal rotatable transverse shaft at proximal end portions of corresponding interconnecting link to said pivot members coupling distal end portions of the corresponding interconnecting link and said distal transverse shaft locking said multi-bar change point apparatus in the deployed position.

* * * * *